US006851965B1

(12) United States Patent
Czabanski et al.

(10) Patent No.: US 6,851,965 B1
(45) Date of Patent: Feb. 8, 2005

(54) PLUG-IN CONNECTING SYSTEM FOR FILM-INSULATED CONDUCTORS

(75) Inventors: Joachim Czabanski, Stuttgart (DE); Jochen Krieger, Bergkamen-Oberaden (DE)

(73) Assignee: Fraunhofer-Gesellschaft zur Forderung der angewandten Forschung e.V., Munich (DE)

( * ) Notice: Subject to any disclaimer, the term of this patent is extended or adjusted under 35 U.S.C. 154(b) by 0 days.

(21) Appl. No.: 10/129,304

(22) PCT Filed: Nov. 7, 2000

(86) PCT No.: PCT/EP00/10988

§ 371 (c)(1),
(2), (4) Date: Sep. 27, 2002

(87) PCT Pub. No.: WO01/35496

PCT Pub. Date: May 17, 2001

(30) Foreign Application Priority Data

Nov. 8, 1999 (DE) ..... 199 53 646

(51) Int. Cl.[7] ..... H01R 11/20
(52) U.S. Cl. ..... 439/391; 439/422; 439/492
(58) Field of Search ..... 439/422, 492, 439/391, 411, 432

(56) References Cited

U.S. PATENT DOCUMENTS

| | | | | |
|---|---|---|---|---|
| 3,201,744 A | | 8/1965 | Dean | |
| 3,353,141 A | | 11/1967 | Budai | |
| 3,639,891 A | | 2/1972 | Anhalt et al. | |
| 3,702,982 A | | 11/1972 | Kelly et al. | |
| 3,727,170 A | * | 4/1973 | Mosier et al. | 439/59 |
| 3,891,293 A | | 6/1975 | Jones | |
| 3,932,018 A | | 1/1976 | Parsons et al. | |
| 4,062,616 A | | 12/1977 | Shaffer et al. | |
| 4,571,013 A | | 2/1986 | Suffi et al. | |
| 5,336,109 A | | 8/1994 | Hillbish et al. | |
| 5,356,315 A | | 10/1994 | Jankowski et al. | |

FOREIGN PATENT DOCUMENTS

| | | |
|---|---|---|
| DE | 23 44 381 | 3/1974 |
| DE | 24 23 189 A1 | 1/1975 |
| DE | 27 37 328 A1 | 2/1978 |
| DE | 34 29 973 A1 | 1/1986 |
| DE | 42 39 988 A1 | 6/1994 |
| DE | 196 13 385 A1 | 10/1997 |
| DE | 197 41 603 A1 | 3/1999 |
| EP | 0 239 422 | 9/1987 |
| EP | 0 653 805 A2 | 5/1995 |
| GB | 1 425 477 | 2/1976 |

* cited by examiner

*Primary Examiner*—Hung V. Ngo
(74) *Attorney, Agent, or Firm*—Burns, Doane, Swecker & Mathis, L.L.P.

(57) ABSTRACT

A plug-in connecting system for flexible conductor films with film-insulated conductors, including a plug-in unit and a counter plug-in unit, which are each provided on a terminal zone of the conductor film and adapted to be inserted into each other for the purpose of establishing an electrical contact of said film-insulated conductors. The plug-in unit and the counter plug-in unit each have a base body and a top which can be brought into an intimate solid contact via a fixing mechanism in said base body, and that at least one penetration structure is provided between said base body and said top, into which a film-insulated conductor of the terminal zone of the conductor film can be inserted before a contact is established between said top and said base body and which penetrates, at least partly, said film-insulated conductor for fixing and establishment of an electrical contact exclusively by pressing said top against said base body.

20 Claims, 7 Drawing Sheets

Prior Art

PLUG-IN CONNECTING SYSTEM FOR FILM-INSULATED CONDUCTORS

FIELD OF THE INVENTION

The present invention relates to a plug-in connecting system for flexible conductor films with film-insulated conductors, comprising a plug-in unit and a counter plug-in element, whereof each is provided on a terminal conductor film area and can be inserted into each other in order to contact the film-insulated conductors.

BACKGROUND OF THE INVENTION

Flexible conductor films are used frequently in consumer electronics and electronic equipment for entertainment, as well as in vehicle construction, particularly where a selective establishment of electrical contacts is desired mostly between a plurality of electrical contacting sites with highly restricted space conditions only. Flexible conductor films—which are also referred to as conductor films loose in bending—have a low weight and permit an orderly parallel extension of a plurality of separate strip conductors due to its flexible tape structure. In view of specific demands, also appropriately configured flexible conductor films are used instead of common electrical connecting techniques such as the provision of individual isolated connecting wires, which conductor films are suitable to withstand any mechanical influences from the outside, such as vibrations, without being damaged. This connecting technique has been generally adopted particularly in the manufacture of photographic cameras.

In the field of flexible conductor films, a fundamental distinction is made between two different concepts:

Conductor films in which the strip conductors extend exclusively in parallel in one direction, in a way similar to the extension in ribbon cables, are referred to as flexible flat film conductors (FFC=flexible flat cable). Film conductors of this kind are exclusively used for the electrical connection among a plurality of electrical contact sites.

In distinction herefrom, flexible printed-circuit boards may present additional electrical circuits that are projected by appropriate printing techniques onto the flexible conductor films. These film conductors, which are also known as FPC (flexible printed circuits), are provided with planar structures on the film by specific production methods.

For establishing the electrical contacts of the flexible conductor films with components such as printed-circuit boards or other electrical or electronic functional elements not only plugs but also soldering and adhesive bonding techniques are applied. In the field of the plugs, different principles are known which are each distinguished in terms of the joining forces required for attachment of the plug on the conductor film. For example ZIF plugs are distinguished from LIF plugs (ZIF=zero insertion force; LUF low insertion force), for instance, but with both plug types it is necessary, as a rule, that the insulation must be stripped from the contacting zone prior to attachment of the plug.

Moreover, plugs are known which penetrate the insulating layers provided on the flexible conductor films, thus establishing the electrical contact with the strip conductors. Such penetration-type mated connector sets, as they are often referred to, comprise contact pins that penetrate both the insulating layers and the conductor layer of the film-insulated conductors and are so bent on the underside of the conductor films in such a way that a lateral nondestructive withdrawal of the film out of the penetration-type mated connector sets is no longer possible.

FIG. 1 shows a cross-sectional view of a penetration-type mated connector set—known per se. The strip conductor 1 to be contacted ends on one end in the penetration type mated connector set 2 that is inserted into a housing with an upper cover plate 3 and a lower cover plate 3'. Both cover plates are articulated on each other on one side (not illustrated) so that they can be pressed against each other until they enter a closed position (which is illustrated in FIG. 1) and can be locked relative to each other via appropriate contours. The penetration-type mated connector set 2 presents a metallic contact pin array 4 between the cover plates 3, 3', which array encompasses the strip conductor 1 via one of its lateral edges and locally penetrates through the strip conductor by means of suitably shaped contact pin structures 41 and 42. The penetrating operation is realised by means of a suitable tool, e.g. a crimping tool, which shapes the contact pin structures in an appropriate manner, as is illustrated in FIG. 1. The crimping tool encompasses the contact pins directly by passing through the cover plate 3', on the one hand, from below and, on the other hand, from above still before the upper cover plate is closed, whilst it deforms the contact pins. Then the cover plates 3 and 3' are joined to each other.

It is not possible to remove the strip conductor 1 laterally from the closed penetration-type mated connector set 2.

The known penetration-type mated connector set presents, however, a number of disadvantages. For instance, at least one tool is required for establishing a permanent connection between the film-insulated conductor and the penetration-type plug, which serves to realise a selective deformation of the contact pin structures. The known plug presents unprotected and freely accessible terminal contact areas suitable for being fitted into a corresponding counter plug-in element; one cannot preclude, however, that incorrect contacting may be possible, for instance by twisted joining, when the plug and the counter plug-in element are inappropriately joined with each other. Moreover, constellations can occur in which the plug contact areas may be damaged, which renders the plug-in connection system entirely unusable.

It is frequently desired to dispose plug-in contacts in optional numbers in a side-by-side relationship and one on top of the other in order to create in this manner free selectable plugging panel arrays with a predetermined dimensional stability in terms of the modular dimensions. These potential arrangements are not possible with the known plug-in connecting systems.

SUMMARY OF THE INVENTION

The present invention is based on the problem of improving a plug-in connecting system for flexible conductor films, comprising a plug-in unit and a counter plug-in element whereof each is provided on a terminal zone of the conductor film and which are adapted to be plugged into each other for the purpose of establishing an electrical contact of the film-insulated conductors, in such a way that the aforementioned disadvantages as well as the intentions described above can be appropriately considered. In particular it should be possible to contact the film-insulated conductors inside the plug in a single step and to enclose, at the same time, the terminal zone of the conductor film with a protective housing, preferably without the need to use expensive crimping or pressing tools. The plug-in unit and the counter plug-in unit should present provisions for the protection of the areas of the electrical contacts from outside mechanical influence, and moreover they should be configured in a way that an unambiguous joining of the plug-in unit and the counter plug-in unit will be possible. To this end, provisions should be made to permit both protection from rotation between the plug-in unit and the counter plug-in unit as well as an unambiguous coding so that an inappropriate association can be precluded between the plug-in unit and the counter plug-in unit. Eventually, the plug-in connection system consisting of the plug-in unit and the counter plug-in unit should be suitable for optional three-dimensional combination, i.e. for stacking in a vertical and a horizontal direction, so that an invariable network arrangement of the contact areas can both in the horizontal and the vertical directions.

The solution to the problem underlying the invention is defined in claim 1. Features improving the inventive idea in an expedient manner can be derived from the dependent claims as well as the description and the embodiments with reference to the Figures.

In accordance with the present invention, a plug-in connection system for flexible conductor films with film-insulated conductors, a plug-in unit and a counter plug-in unit, which are each provided on a terminal zone of the conductor film and which are adapted for being plugged into each other for the purpose of establishing an electrical contact of the film-insulated conductors, is so configured that the plug-in unit and the counter plug-in unit each have a base body and a top which can be brought into intimate solid contact with the base body by means of a fixing mechanism. Moreover, at least one respective penetration structure is provided between the base body and the top, into which a film-insulated conductor of the terminal zone of the conductor film can be inserted prior to the establishment of the contact of the top with the base body and which penetrates, at least in part, the film-insulated conductor for the purpose of fixing and electrically contacting by exclusively pressing the top against he base body, respectively.

The novel plug-in connecting system permits a simple and rapid contacting and confectioning of film-insulated conductors. For instance, the film conductor is inserted into the mated connector set and a planar force oriented directly on the top and the base body is capable of deforming the penetration structure for the purpose of establishing the electrical contact of the film conductor.

To this end, the penetration structure, which is inserted between the top and the base body, presents a pliers-type shape with two jaws of tongs located one on top of the other, whereof preferably the lower jaw is provided with pointed penetration bodies. In a preferred embodiment, the pointed penetration bodies provided on the jaw of tongs are configured as triangular moulded bodies that project with the tip of the triangle at an angle upwards from the plane of the jaw of tongs and consist of the same material as the jaw of tong. When a film-insulated conductor is placed between the jaws of tong the pointed penetration bodies are capable to drill through the insulation of the film conductor while both jaws of tongs are compressed against each other, which establishes a direct contact with the conductor. In distinction from prior art, this penetration operation can be carried out by direct application of force on the top as well as the base body, specifically as the pliers-type configured penetration structure is placed between the top and the base body.

During the penetration operation firstly the pointed penetration bodies drill through the flexible conductor film for mechanically fastening it fixedly within the plug-in unit or the counter plug-in unit, respectively, and secondly establish an electrical contact with the film-insulated conductor. Moreover, the pointed penetration bodies are bent out of their raised position so that in this manner they are actually engaged by claws and fixed in the material of the film conductor. On account of an offset arrangement of a plurality of penetration bodies along a jaw of tongs, which will be described in more details in the following, it is possible to ensure a reliable fastening. The penetration operation is completed as soon as the top is carried into an intimate solid contact with the base body via a fixing mechanism that is preferably configured in the form of opposing locking projections. The operation for the attachment of a plug-in unit or a counter plug-in unit, respectively, on a terminal zone of a flexible conductor film is hence completed. Further steps of operation, which are the rule in prior art, are no longer possible.

With a laterally defined distance, it is, of course, possible to provide an optional plurality of pliers-type configured penetration structures between the top and the base body of a plug-in unit or a counter plug-in unit, respectively. The number of the individual penetration structures placed one beside the other within a combination of a plug-in unit with a counter plug-in unit is governed by the number of film-insulated conductors to be electrically connected.

Each penetration structure presents a contacting zone on its end opposite to the open tong region, which, in the case of a plug-in unit, is configured as so-called male contact, i.e. in the form of a contact finger. When a counter plug-in unit is involved the contacting zone of the penetration structure is configured in the form of a female contact, i.e. in the form of some kind of recess into which the contact finger of the male contact can be inserted with close fit for establishing the contact.

The base body of the plug-in unit as well as of the counter plug-in unit presents both a receiving zone for accommodating the penetration structure and a joining zone for fitting the plug-in unit and the counter plug-in unit into each other for reasons of electrical contact and the possibility of mutual joining. In the case of the plug-in unit, the joining zone is provided with an insertion passage having a unilaterally open configuration, on whose side opposite the side having an open configuration is provided with a passage leading to the receiving zone through which project the contacting zones of the individual penetration structures.

The joining zone of the counter plug-in unit, by contrast, presents an outside contour that is adapted for insertion with close fit into the insertion passage of the joining zone of the plug-in unit. With the appropriate selection of the geometry of the insertion passage and the outside contour of the joining zone of the counter plug-in unit it is possible to create means for projection from rotation for the plug-in connection system, which precludes an involuntary mutual joining of the plug-in unit and the counter plug-in unit in an improper constellation. Plug codings can be realised in this manner, which can be realised by the selection of different three-dimensional shapes within the respective connection zones.

For electrical contacting of the counter plug-in unit the latter comprises at least one penetration passage within its connection zone, which passage extends freely into the receiving zone on the counter plug-in unit on its side opposite the side with the open configuration. The contacting zone configured as female contact of the penetration structure designed for the counter plug-in unit can be inserted through the penetration passage.

For reasons of a mechanical protection of the contacting zones, for or both elements, the plug-in unit and the counter plug-in unit, the connecting zones are configured in such a way that they project completely beyond the contacting zones formed inside the connecting zones. It can thus be ensured that the contacting zones configured as contact fingers or female contacts will be protected, for example from unintentional bending.

Irrespectively of whether a plug-in unit or a counter plug-in unit is involved, both the top and the base body present pin-like projections and/or recesses on their upper side turned away from the penetration structure, by means of which projections or recesses the plug-in units or the counter plug-in units engage in each other with horizontal or vertical stacking so as to ensure a mechanically stable stack. A particular aspect of stackability of plug-in units or counter plug-in units, respectively, is the creation of individual contacting sites with a panel-like structure, whose mutual spacings correspond to invariably predetermined modular dimensions.

The top as well as the base body are manufactured of dielectric materials, preferably synthetic materials that can be processed by means of injection moulding techniques or casting techniques, respectively. The formation of the top and the base body in the form of a single integrally coherent component is particularly expedient for both the production and the subsequent processing. The top and the base body are preferably connected to each other via two separating seams in whose zones the injection moulding material is strongly thinned. This configuration is particularly advantageous for manufacture because the top and the base body can be produced in a single manufacturing process, for example with application of the injection moulding technique. For further processing their configuration is expedient for reasons of simple and reliable joining of the top and the base body. For instance, the top and the base body are positioned relative to each other with a high precision via the separating seams so that subsequent joining is possible in a faultless manner without mutual tilting.

The separating seam bursts only after the appropriate insertion of the film-insulated conductors to be contacted between the penetration structures due to area compression of the top against the base body, so that subsequently a mechanical fixing is achieved between the top and the base body along the envisaged locking projections.

The provision of separating seams in the production of the plug-units as well as of the counter plug-in units moreover presents the advantage that in the assembly of plug-in units and counter plug-in units one is not bound to manipulate a great number of loose components, which are partly of very small dimensions, which could render the confectioning operation substantially more difficult. In this manner it is also possible to avoid mismatching between the tops and the base bodies due to existing tolerances in manufacture, particularly, as such imprecision produces its effects in the production of a one-piece product which, even though it is composed of two different partial regions, takes an influence on the component in its entirety.

BRIEF DESCRIPTION OF THE DRAWINGS

The present invention will be described in the following by exemplary embodiments, without any limitation of the general inventive idea, with reference to the drawing wherein.

DETAILED DESCRIPTION OF THE INVENTION

Figure 1:
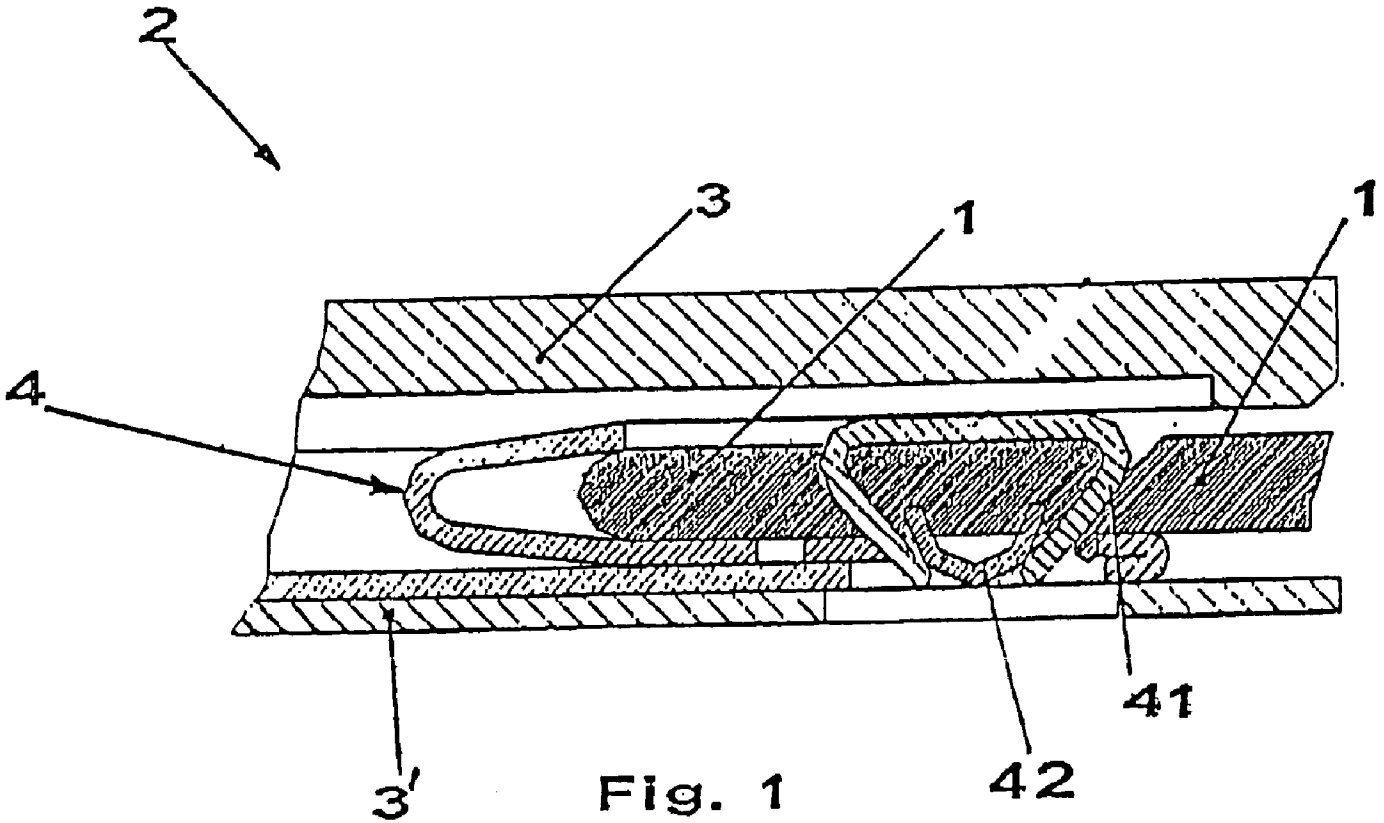
FIG. 1 is a cross-sectional view taken through a known plug-in contact.

Here reference is made to the known embodiment of a penetration-type plug-in connector that is illustrated in FIG. 1, with explicit reference being made to the fact that here prior art is involved.

Figure 2:
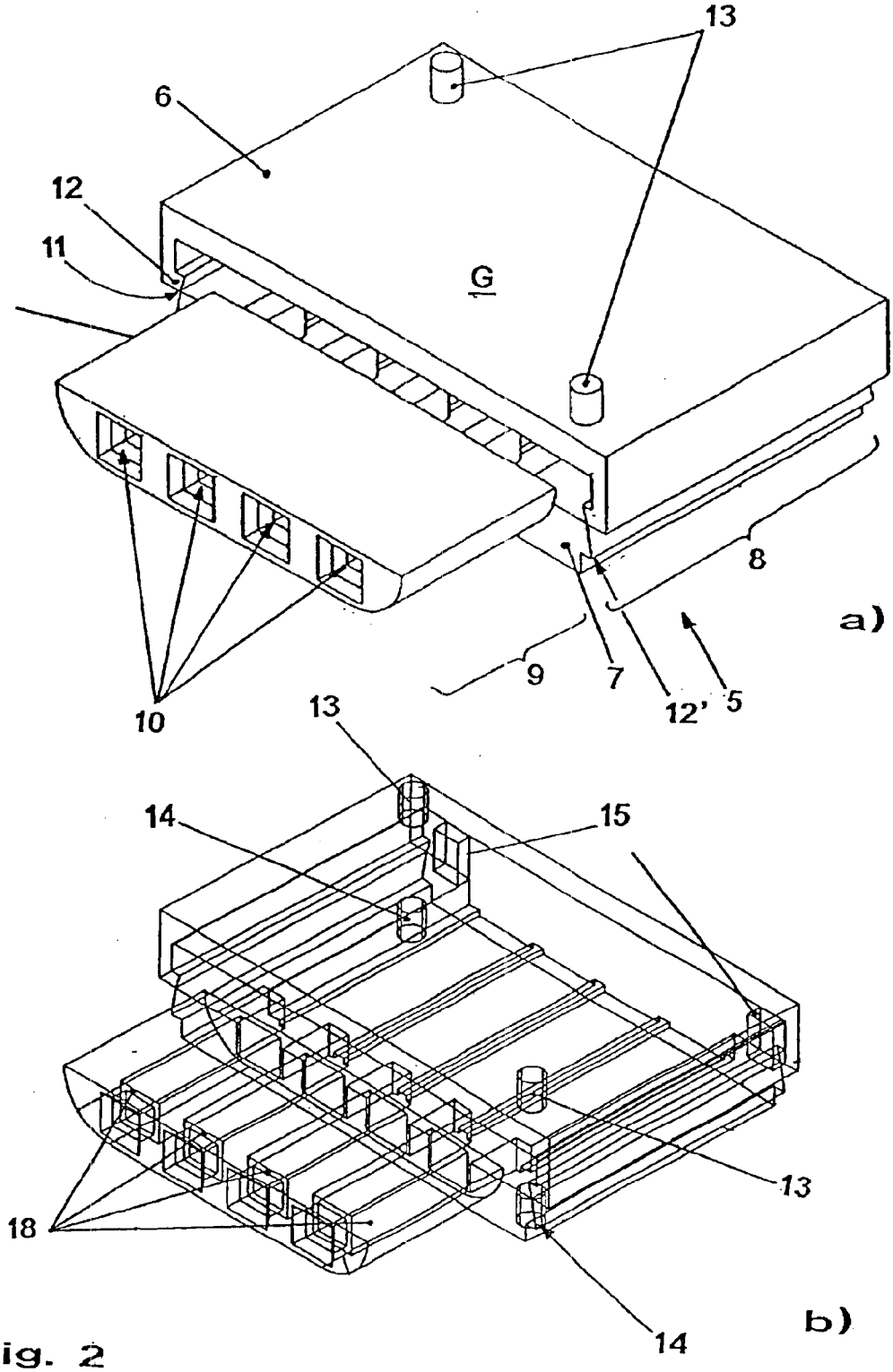
FIGS. 2*a, b* are perspective illustrations of a counter plug.

FIG. 2*a* is a strongly schematized perspective view showing one embodiment of a counter plug-in unit whose housing 5 is of a one-piece design, preferably manufactured from a synthetic material by an injection moulding process and consisting of a top 6 and a base body 7. The base body 7, on its turn, comprises a receiving zone 8 beyond which the top 6 substantially projects. A connecting zone 9 is integrally mounted on the receiving zone 8 and presents passage passages 10 that will be discussed in details in the following.

In the case illustrated according to FIG. 2*a*, the top 6 comprises two separating seams 11 representing weak connecting bridges between the top 6 and the base body 7. The separating seams 11 are due to the injection moulding process and ensure an unambiguous three-dimensional relationship between the top 6 and the base body 7. Moreover, the top 6 carries locking projections 12 along the separating seams 11, which, after appropriate compression, engage between the top 6 and the base body 7 in counter locking projections 12' on the base body 7, so as to achieve an intimate solid joint between the top 6 and the base body 7.

In the illustration according to FIG. 2*a*, the housing 5 of the counter plug-in unit G is shown as an injection-moulded part having a hollow configuration within for insertion of penetration structures, as will be represented in the following. Pin-like extensions 13 are provided on the upper side of the top 6, which may open into correspondingly shaped recesses provided on the underside of the base body 7. In this manner, any number of counter plug-in unit housings can be stacked one on top of the other in a vertical arrangement.

FIG. 2*b* shows a perspective outline drawing that illustrates the inside structure of the housing 5 of the counter plug-in unit G. Without using the reference numerals used in FIG. 2*a*, in order to avoid impairment of the clarity of the illustration, reference is made to FIG. 2*a* in this context. The illustration in FIG. 2*b* shows pin-like recesses 14 on the underside of the base body 7, into which the pin-like extensions 13 engage when several counter plug-in units are appropriately stacked one on top of the other. In order to prevent the top 6, which is arranged in a solid intimate connection with the base body 7 along two locking projections 12, from displacement in the direction of the extension of the locking projections, additional retaining elements 15 are provided on the base body 7, which bear against the top 6 directly and prevent a sliding movement along the locking projections 12 by the effect of a mechanical stop. The outside contour of the connection zone 9 is designed with rounded-off edges, as may also be seen from the illustration according to FIG. 2*a*, so that protection from rotation is ensured for joining the plug-in connection system.

The through passages 10, which extend through the connecting zone 9, ensure a provision for receiving the contacting zones 18 of the penetration structures which, in the case of the counter plug-in unit G, as configured as female contacts. This will be explained in more details with reference to FIG. 4.

Figure 3:
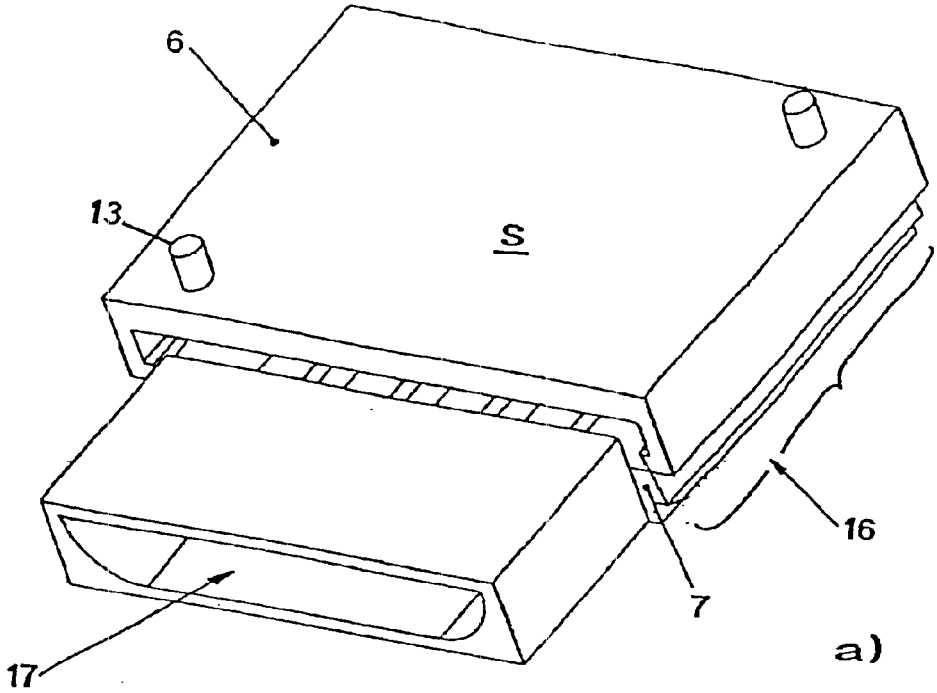
FIGS. 3*a, b* are perspective views of a plug-in unit.
Figure 3:
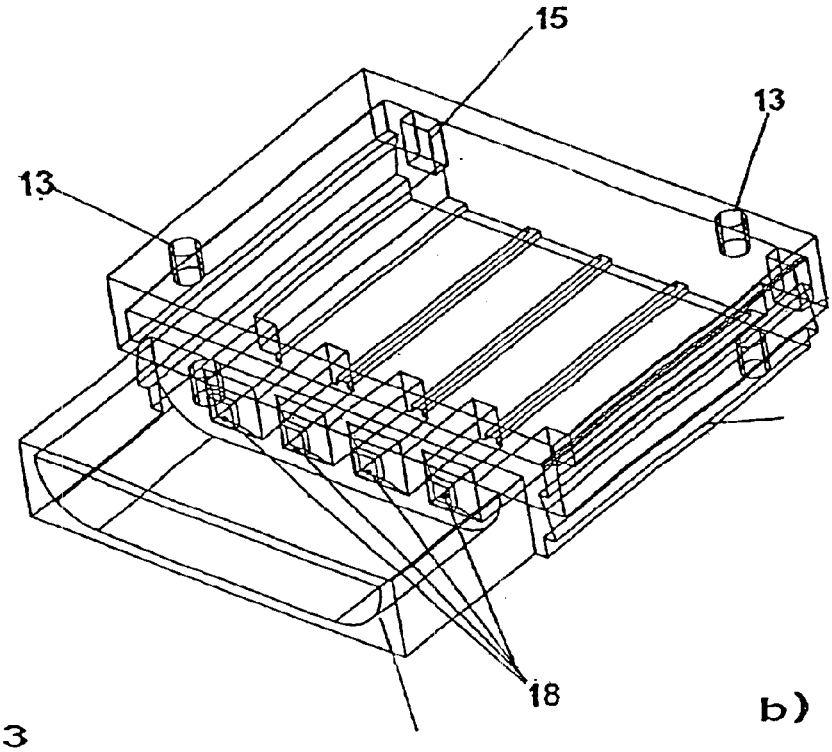

The plug-in unit S has a similar structure, which is shown in a perspective view in FIGS. 3*a* and 3*b*. The housing 16 of the plug-in unit S has a configuration like that of the housing 5 of the counter plug-in unit G, at least as far as the top 6 and the base body 7 in the receiving zone 8 is concerned. In distinction from the housing 5 of the counter plug-in unit G, the connecting zone is formed on the housing 16 of the plug-in unit S has the connecting zone that provides for an insertion passage 17 whose inside contour is matched with the outside contour of the connecting zone 9 of the counter plug-in unit G. In this manner, it is possible to introduce the connecting zone 9 of the counter plug-in unit G into the insertion passage 17 of the housing 16 of the plug-in unit S with precise fit.

In order to avoid repetitions, reference is made to the reference numerals in the illustrations of FIGS. 2*a*, 2*b* as far as components of the housing 16 of the plug-in unit S are concerned, which have the same configuration.

In the case of the plug-in unit S, too, the housing 16 offers the possibility of insertion of penetration structures from one side into the interior of the receiving zone 8, with the contacting zones 18' of the penetration structures projecting into the insertion passage 17 on one side.

In the case illustrated in FIG. 3*b*, the contacting zones 18' are already drawn in the illustration in the appropriate manner. The penetration structures that must be inserted into the interior of the housing of the counter plug-in unit are illustrated in FIGS. 4 and 5.

Figure 4:
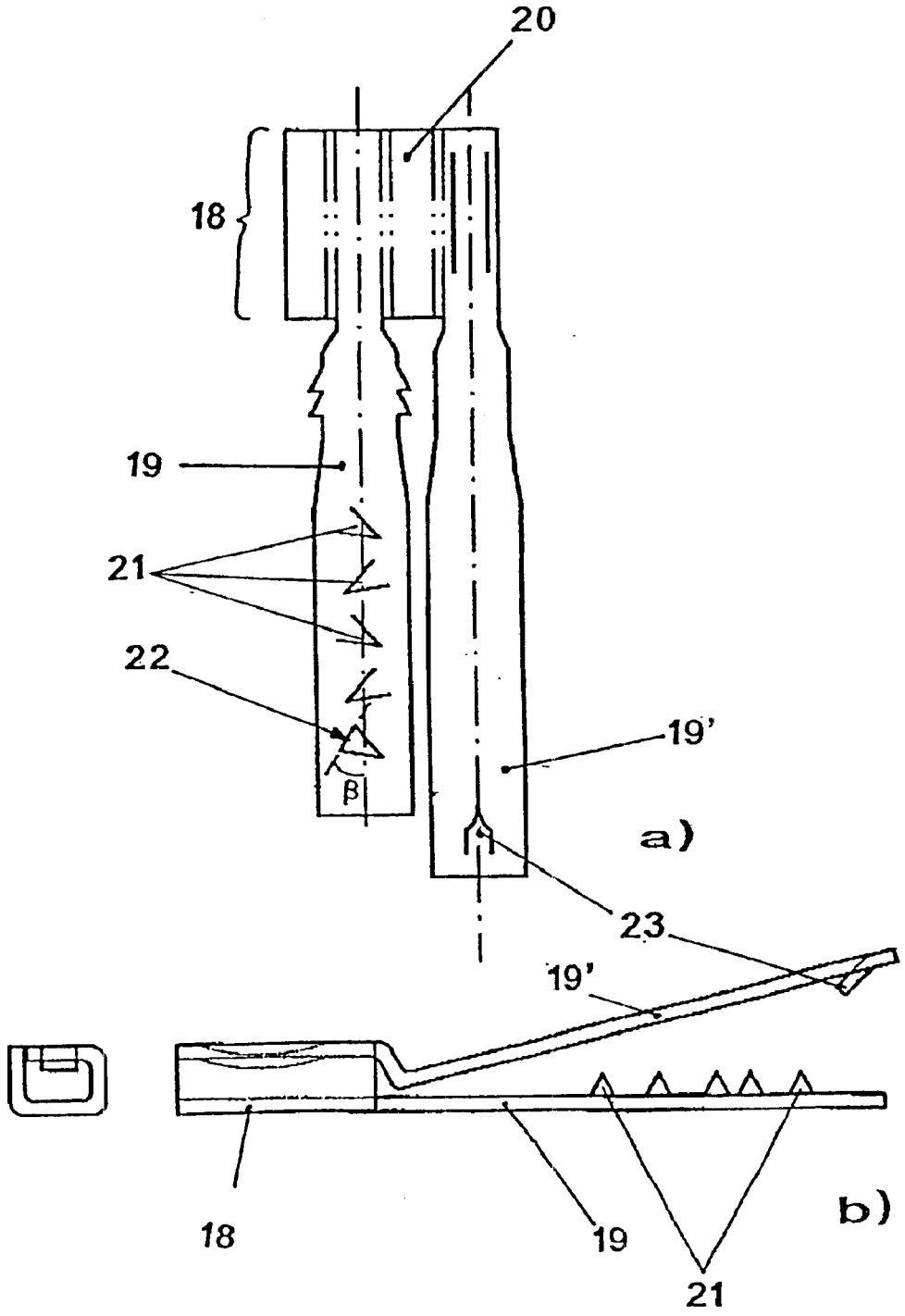
FIGS. 4*a, b* are a schematic plan view and side view of a penetration structure for a counter plug, FIGS. 5*a, b* are a plan view and a side view of a penetration structure for a plug-in unit, FIGS. 6*a, b* show illustrations of potential coding between the plug-in unit and the counter plug.

FIG. 4 shows a penetration structure for the insertion in the counter plug-in unit G, which is made of metal and has a tong-like configuration. FIG. 4*a* shows the plan view on two tong jaws 19, 19' which are disposed in a side-by-side relationship and are integrally produced from a flat material, preferably a metal material. Both tong jaws 19, 19' are connected at their upper ends via an area zone 20 that furnishes the contacting zone 18 after appropriate folding. Penetration bodies 21 with a triangular shape and punched out of the material of the tong jaws are disposed on the lower tong jaw 19. The penetration bodies 21 with a triangular configuration present each a base 22 of the triangle, which is disposed in rotated position in alternation relative to the axis A of the tong jaw. The base 21 of the triangle encloses an angle β of ±60° relative to the axis A of the tong jaw. In this manner, the individual penetration bodies 21 can actually engage with claws in the flexible conductor film after penetration of the film-insulated conductor to be fixed and to be contacted electrically so that the conductor film will be penetrated by the penetration bodies 21 in a manner reliably preventing a sliding movement. On the opposite tong jaw 19', no penetration bodies are provided, merely a retaining pin 23 is provided there which constitutes a further protection from extraction of the flexible conductor film out of the penetration structure, which must be prevented.

The lateral view in FIG. 4*b* shows the penetration structure in a completely bent condition, with the area zone 20 constituting a contacting zone 18 that is configured as female contact. The opened tong jaws 19, 19' are disposed in a vertical stack, with the lower tong jaw 19 providing the penetration bodies 21. The penetration bodies 21 project beyond the plane of the tong jaw 19 and form an angle of inclination a relative to the plane of the tong jaw, which is different from 90°. In this manner, it is ensured that when the tong jaws 19' are lowered the penetration bodies 21 are bent in a predetermined manner. The retaining pin 23 ensures an appropriate upper counter stop in order to prevent a sliding movement of a flexible conductor film inserted into and fixed in the penetration structure. To the left side of the lateral view, a front view of the contacting zone 18 is illustrated, which is configured as female contact. The female contact has a recess into which the male contact shown in FIG. 5 can be inserted with a precise fit.

Figure 5:
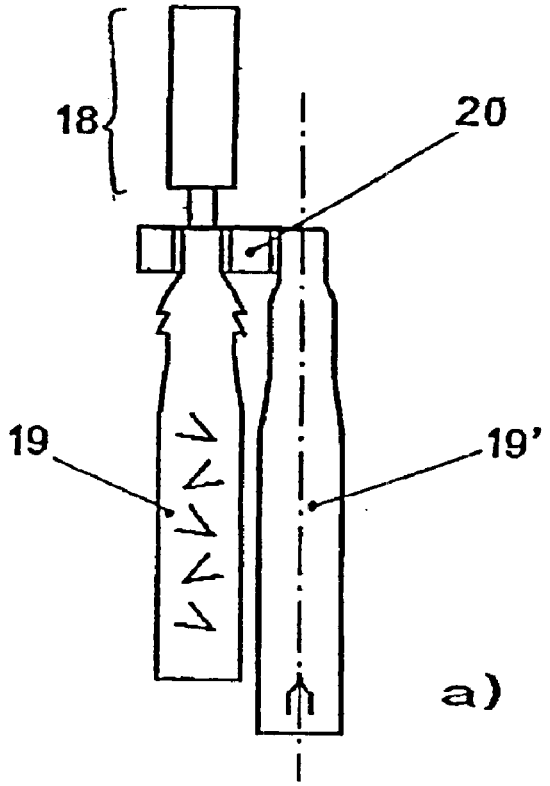
Figure 5:
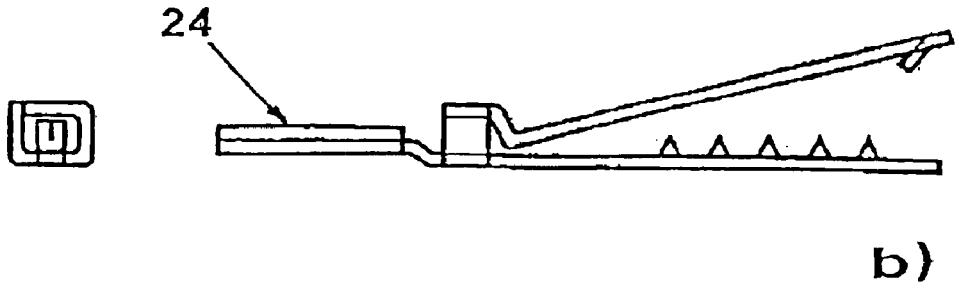

The penetration structure provides for a corresponding configuration for the plug-in unit S that is illustrated in FIGS. 5*a*, 5*b*. In distinction from the penetration structure for the counter plug-in unit G, the penetration structure according to FIG. 5 has a contacting zone 18' configured as a male contact. Here, the area element 20, which connects the tong jaws 19, 19' to each other, forms a contact finger 24 after appropriate folding, as can be seen in FIG. 5*b*. The contact finger illustrated in FIG. 5*b* is appropriately matched, in terms of size and length, with the female contact shown in FIG. 4*b* so that the contact finger 24 can be inserted into the female contact with a precise fit.

The penetration structure shown in FIG. 4*b* is now inserted into the housing 5 of the counter plug-in unit G, which has an open configuration. The counter plug-in unit G according to FIG. 2 offers sufficient space for four individual penetration structures. In an approach to avoid an unclear illustration in FIG. 2*b*, the tong zones of the penetration structures have been omitted in the drawing even though the female contact zones 18 can be seen in the through passages 10 in FIG. 2*b*. The same applies by way of analogy to the illustration in FIG. 3*b* that shows the contacting zones 18' with a finger-like configuration on the penetration bodies represented in FIG. 5.

Figure 6:
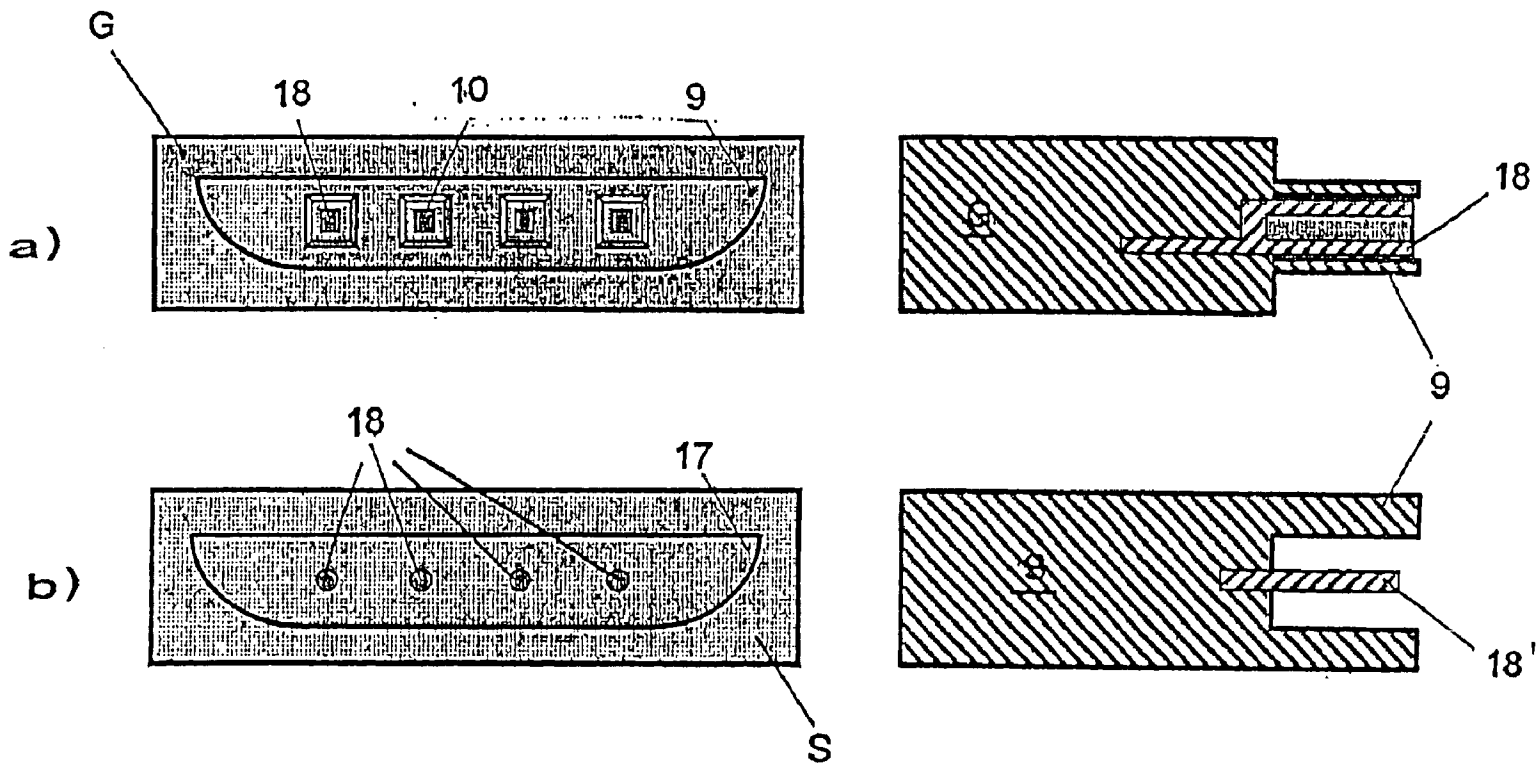

The left illustration in FIG. 6*a* shows a plan view of the connecting zone 9 of the counter plug-in unit G. What can be recognized is the characteristic rounding of the edges of the outside contour of the connecting zone 9, which is made in order to achieve a defined plugging coding. The contact zones 18 of the female contacts are centred on the through passages 10. The right illustration in FIG. 6*a* shows a cross-sectional view through the connecting zone 9 of the counter plug-in unit G. The connecting zone 9 projects beyond the contact zones 18 in order to protect them from mechanical action from the outside. The left illustration in FIG. 6*b* correspondingly shows the plan view on the connecting zone 9 of a plug-in unit S, which comprises four contacting zones 18' disposed in a side-by-side relationship and configured as contact fingers. The insertion passage 17 here presents an inside contour that corresponds to the outside contour of the connecting zone 9 of the counter plug-in unit G. In correspondence, a cross-section from the connecting zone of the plug-in unit S can be seen in the right illustration in FIG. 5*b*. Here, too, the connecting zone 9 completely projects beyond the contacting zone 18' that is configured as contact finger, so as to protect the latter from mechanical action from the outside.

Figure 7:
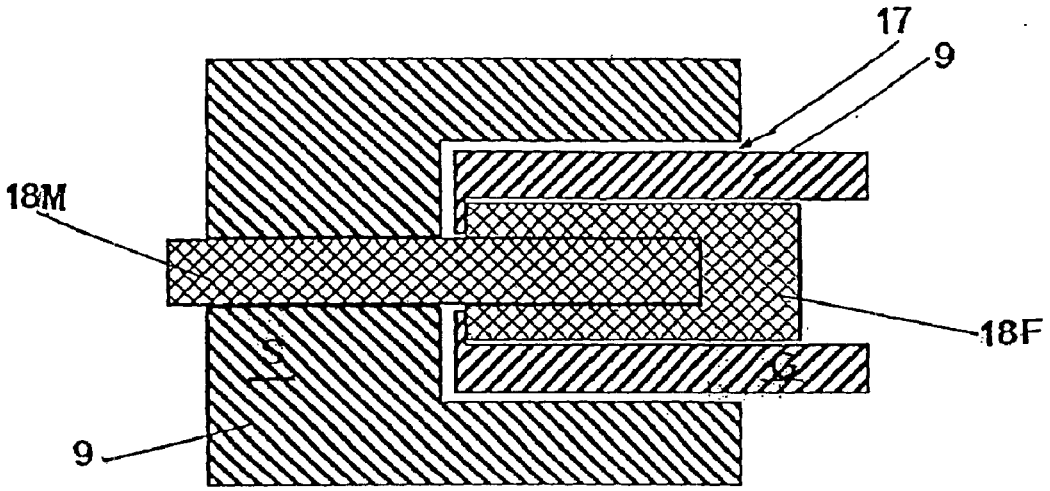
FIG. 7 is a cross-sectional view taken trough a plug-in connection system between the plug-in unit and the counter plug, and finally

FIG. 7 shows a cross-sectional view from the connecting zone of a counter plug-in unit G that is connected to the plug-in unit S. The connecting zone 9 of the plug-in unit S has a contacting zone 18M of a pin-like configuration, which projects into the insertion passage 17. The connecting zone 9 of the counter plug-in unit G is inserted into the insertion passage 17 of the plug-in unit S, with the contact finger 18M projecting into the female contact 18F.

Figure 8:
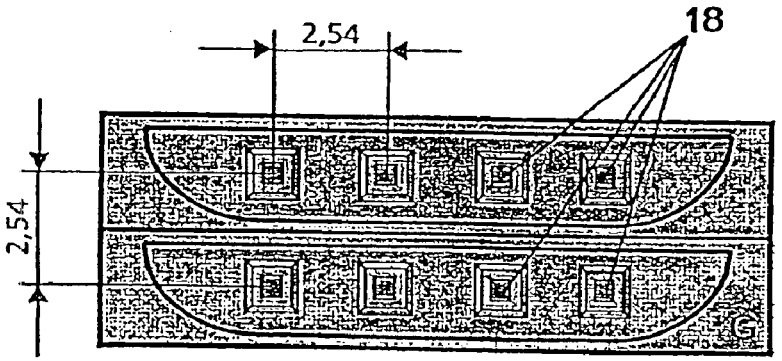
FIG. 8 illustrates the stackability of a counter plug.

FIG. 8 illustrates an arrangement of two counter plug-in units G stacked one on top of the other, in which the modular dimensions both in the horizontal and the vertical direction of the contacting zone 18 can be seen. The mutual spacing of two adjacent contacting zones 18 is defined both in the horizontal and the vertical direction for stackability of the counter plug-in units—the same applies equally to the plug-in unit. In the embodiment according to FIG. 8, each of the contacting zones is disposed in a square arrangement. With the standardised modular dimensioning of the contacting zones unambiguous plug assignments and plug-in connections are possible.

LIST OF REFERENCE NUMERALS

| List of Reference Numerals | |
|---|---|
| 1 | strip conductor |
| 2 | penetration plug-in connection system |
| 3 | upper, lower top element |
| 4 | contacting pin array |
| 41, 42 | contacting pins |
| 5 | housing |
| 6 | top |
| 7 | base body |
| 8 | receiving zone |
| 9 | connecting zone |
| 10 | through passage |
| 11 | separating seam |
| 12 | locking projection |
| 13 | pin-like extension |
| 14 | pin-like recess |
| 15 | retaining element |
| 16 | housing |
| 17 | insertion passage |
| 18 | contacting zones |
| 19, 19' | tong jaws |
| 20 | area zone |
| 21 | penetration body |
| 22 | base of triangle |
| 23 | retaining pin |
| 24 | contact finger |
| A | axis of the tong jaws |
| G | counter plug-in unit |
| S | plug-in unit |

What is claimed is:

1. Plug-in connecting system for flexible conductor films with film-insulated conductors, comprising:

a plug-in unit and a counter plug-in unit wherein each is provided on a respective terminal zone of a conductor film and which are adapted to be plugged into each other for establishing an electrical contact with film-insulated conductors, wherein said plug-in unit and said counter plug-in unit each have a base body and a top which can be brought into contact via a fixing mechanism in said base body, that at least one integral penetration structure made of an electrically conductive material is provided between said base body and said top, which is configured in the manner of a tong and comprises two tong jaws one placed on top of the other, wherein at least one of said tong jaws comprises penetration bodies into which at least one film-insulated conductor at said terminal zone of the conductor film can be inserted before said top is brought into contact with said base body and which penetrates, at least partly, said at least one film-insulated conductor for fixing and establishment of an electrical contact exclusively by pressing said top against said base body.

2. Plug-in connecting system according to claim 1, wherein said penetration bodies are pointed shaped bodies projecting from the at least one tong jaw and enclosing an angle of inclination 90° relative to the at least one tong jaw.

3. Plug-in connecting system according to claim 1, wherein said penetration bodies are triangular shaped bodies formed of material identical to material from which the tong is made, having a point of the triangle, which projects from said at least one tong jaw, and wherein at a base of the triangle, which is opposite to the point of the triangle in the at least one tong jaw, said triangular shaped bodies are bent.

4. Plug-in connecting system according to claim 3, wherein said penetration bodies are disposed at an angle of R relative to a longitudinal axis of the at least one tong jaw.

5. Plug-in connecting system according to claim 4, wherein, relative to the longitudinal axis of the at least one tong jaw, said penetration bodies are disposed in a tandem arrangement, respectively in alternation, at an angle of $\beta=\pm 60°$.

6. Plug-in connecting system according to claim 1, wherein a plurality of respective penetration structures is provided between said base body and said top, which are laterally spaced from each other and whose mutual lateral spacing corresponds to the arrangement of film-insulated conductors on the terminal zone of the conductor film.

7. Plug-in connecting system according to claim 1, wherein said penetration structure has a contacting zone that is configured as male contact in the case of said plug-in unit or female contact, in the case of the counter plug-in unit.

8. Plug-in connecting system according to claim 7, wherein said connecting zones of said plug-in unit as well as of said counter plug-in unit have a length corresponding at least to the length of the respective contacting zones.

9. Plug-in connecting system according to claim 1, wherein said base body has a receiving zone for accommodating said penetration structure and a connecting zone for plugging said plug-in unit and said counter plug-in unit into each other.

10. Plug-in connecting system according to claim 9, wherein in the case of the plug-in unit, said connecting zone provides for an insertion passage with a through-passage to said receiving zone, and wherein in the case of the counter plug-in unit, said connecting zone has an outside contour adapted to be inserted, with precise fit, into the insertion passage of said connecting zone of the plug-in unit, and which includes at least one through-passage terminating freely in said receiving zone of the counter plug-in unit.

11. Plug-in connecting system according to claim 10, wherein said insertion passage has an inside contour with rounded-off edges, such that an unambiguous positional assignment is possible between said plug-in unit and said counter plug-in unit.

12. Plug-in connecting system according to claim 1, wherein said top and said base body comprises pin-like projections and/or recesses on its upper side turned away from said penetration structure so as to ensure a mutually engaged stacking of a plurality of plug-in units as well as counter plug-in units one on top of the other.

13. Plug-in connecting system according to claim 1, wherein said top and said base body are connected to each other via at least one joining seam and assume an opened position in which the introduction of said penetration structure is possible between said top and said base body, and that said joining seam can be destroyed when said top is pressed against said base body, while in the compressed condition, said top and said base body are mutually fastened by said fixing mechanism.

14. Plug-in connecting system according to claim 1, wherein said fixing mechanism is configured in the form of locking projection elements provided on both said top and said base body, which elements are adapted to be brought into an intimate mutual clamping engagement by pressing them against each other.

15. Plug-in connecting system according to claim 1, wherein said top and said base body consist of a material suitable for injection-moulding or casting while these elements can be produced as coherent component in a single injection-moulding or casting operation.

16. Plug-in connecting system for flexible conductor films with film-insulated conductors, comprising:

a plug-in unit and a counter plug-in unit each provided on a respective terminal zone of the conductor film, the plug-in unit and the counter plug-in unit being adapted to be plugged into each other to establish an electrical contact of the film-insulated conductors;

the plug-in unit and the counter plug-in unit each having a base body and a top adapted to be brought into contact via a fixing mechanism;

at least one penetration structure made of an electrically conductive material provided between the base body and the top of the plug-in unit and the counter plug-in unit, the penetration structure including at least one baseplate comprising triangular shaped penetration bodies formed of the baseplate material, with the triangular shaped penetration bodies having a point projecting from the baseplate as well as a base opposite the point about which the triangular shaped penetration bodies are bent;

the penetration structure being adapted to receive the film-insulated conductor of the terminal region of the conductor before the top is brought into contact with the base body, and penetrating at least partly the film-insulated conductor to fix the conductor and establish an electrical contact upon pressing the top against the base body.

17. Plug-in connecting system according to claim 16, wherein the penetration bodies project from the baseplate and enclose an angle of inclination other than 90° relative to the baseplate.

18. Plug-in connecting system according to claim 16, wherein a plurality of triangular shaped penetration bodies is provided on the baseplate, with the base of each triangular shaped penetration body enclosing an angle of ±60° relative to a longitudinal axis of the baseplate.

19. Plug-in connecting system according to claim 16, wherein relative to a longitudinal axis of the baseplate, the penetration bodies are disposed in an alternating tandem arrangement at an angle of $\beta=\pm 60°$.

20. Plug-in connecting system according to claim 16, wherein the at least one integral penetration structure is made of metal.

* * * * *